US007422783B2

(12) United States Patent
Tremblay et al.

(10) Patent No.: US 7,422,783 B2
(45) Date of Patent: Sep. 9, 2008

(54) SUBMERGED HOOKS

(75) Inventors: Heidi S. Tremblay, Ft. Lauderdale, FL (US); Richard Schmidt, St. Simons Island, GA (US); Wallace L. Kurtz, Jr., Lunenburg, MA (US); William H. Shepard, Amherst, NH (US)

(73) Assignee: Velcro Industries B.V., Curacao ( * ) Notice: Subject to any disclaimer, the term of this patent is extended or adjusted under 35 U.S.C. 154(b) by 47 days.

(21) Appl. No.: 10/997,802

(22) Filed: Nov. 24, 2004

(65) Prior Publication Data

US 2006/0107501 A1 May 25, 2006

(51) Int. Cl.
*B32B 3/06* (2006.01)
*A44B 18/00* (2006.01)

(52) U.S. Cl. ..... 428/100; 428/99; 428/319.1; 428/319.3; 428/319.7; 428/316.6; 24/442; 24/451; 24/452

(58) Field of Classification Search ..... 428/99, 428/100, 316.6; 29/412, 428; 24/452
See application file for complete search history.

(56) References Cited

U.S. PATENT DOCUMENTS 3,134,152 A 5/1964 Pei
3,879,835 A 4/1975 Brumlik et al.
3,899,803 A 8/1975 Brumlik et al.
4,025,686 A 5/1977 Zion
4,707,893 A 11/1987 Hashizume et al.
4,775,310 A 10/1988 Fischer
4,776,068 A 10/1988 Smirlock et al.
4,842,916 A 6/1989 Ogawa et al.
4,959,265 A 9/1990 Wood et al.
5,058,245 A * 10/1991 Saito ..... 24/306
5,286,431 A 2/1994 Banfield et al.
5,427,864 A 6/1995 Hikasa et al.
5,540,970 A 7/1996 Banfield et al.
5,611,122 A 3/1997 Torigoe et al.
5,620,769 A 4/1997 Wessels et al.
5,643,651 A 7/1997 Murasaki
5,669,120 A 9/1997 Wessels et al.
5,688,576 A * 11/1997 Ohno et al. ..... 428/100
5,695,845 A 12/1997 Ogawa et al.
5,766,385 A 6/1998 Pollard et al.
5,766,723 A 6/1998 Oborny et al.
5,786,061 A 7/1998 Banfield
5,819,391 A 10/1998 Matsushima et al.
5,853,842 A 12/1998 Gallagher et al.
5,922,436 A 7/1999 Banfield et al.
5,942,177 A 8/1999 Banfield
6,060,146 A 5/2000 Akeno et al.
6,115,891 A 9/2000 Suenaga et al.

(Continued)

FOREIGN PATENT DOCUMENTS

EP 0761116 3/1997

(Continued)

*Primary Examiner*—Hai Vo
(74) *Attorney, Agent, or Firm*—Fish & Richardson P.C.

(57) ABSTRACT

Articles having cooperative fasteners are described. The cooperative fasteners comprise an elongated fastening strip with male fasteners extending from a first surface and foam disposed on the first surface, where at least a portion of the foam extends to a height greater than the height of the male fastener elements. In some instances the article is a hat, a mat, a bag, a garment, or a hair roller.

26 Claims, 13 Drawing Sheets

U.S. PATENT DOCUMENTS

| | | | | |
|---|---|---|---|---|
| 6,143,222 | A | 11/2000 | Takizawa et al. | |
| 6,174,476 | B1 | 1/2001 | Kennedy et al. | |
| 6,187,247 | B1 | 2/2001 | Buzzell et al. | |
| 6,463,635 | B2 | 10/2002 | Murasaki | |
| 6,540,863 | B2 | 4/2003 | Kenney et al. | |
| 6,572,808 | B1 | 6/2003 | Saito et al. | |
| 6,720,059 | B2 * | 4/2004 | Fujisawa et al. | 428/100 |
| 7,132,144 | B2 * | 11/2006 | Roberts | 428/40.2 |
| 2001/0001283 | A1 | 5/2001 | Kennedy et al. | |
| 2002/0023322 | A1 * | 2/2002 | Murasaki | 24/452 |
| 2004/0117955 | A1 | 6/2004 | Barvosa-Carter et al. | |

FOREIGN PATENT DOCUMENTS

| | | |
|---|---|---|
| JP | 278 8564 | 8/1998 |
| WO | WO01/89338 | 11/2001 |

* cited by examiner

SUBMERGED HOOKS

TECHNICAL FIELD

This invention relates to molded cooperative fasteners, and methods of manufacturing and using the cooperative fasteners.

BACKGROUND

Cooperative fasteners are useful to provide means of releasably attaching two objects together, or attaching together two portions of a single object. A male fastener, for example a hook carrying fastener, can become engaged with a female touch fastener, for example a loop carrying fastener, simply by the hooks contacting the loops on the female touch fastener. In some instances, the male touch fastener can become inadvertently engaged with other fibrous materials, such as fabrics and human hair, sometimes damaging such materials. Additionally, the exposure of loop carrying fasteners to fibrous material can cause fouling of the fastener, reducing the effectiveness and the life of the fastener.

SUMMARY

In general, the invention features fasteners in which the exposure of the male fastener elements is decreased at times when the male fastener element is not intended to be engaged. In some instances touch fasteners that include a foam adjacent the hooks are incorporated into objects, including household and consumer objects. In some instances, the height of the foam is greater than the height of the male fastener elements when the fastener is not engaged with a female touch fastener. To engage the male fastener element, the foam is compressed, thus exposing the male fastener elements to allow engagement with the female fastening elements.

In one aspect, the invention includes a touch fastener, including: a sheet form base having an upper face and a lower face; a plurality of male fastener elements, each fastener element having a stem molded integrally with and extending from the upper face of the sheet form base; and a foam positioned adjacent to the upper face of the sheet form base, the foam extending to a height greater than the height of at least some of the male fastener elements, wherein a portion of the foam is disposed between at least some of the fastener elements.

In some embodiments, the touch fastener includes one or more of the following features. The foam can be foam is disposed between substantially all of the fastener elements. The foam can cover substantially the entire upper face of the sheet form base. The foam can be attached to the upper face of the sheet form base, or can be embedded in the upper face of the sheet form base. The foam can be an open cell foam. The fastener elements can be arranged in longitudinally extending tracts. The fastener elements can have a height of less than about 0.05 inch (1.37 millimeters), for example, a height of between about 0.0005 and 0.05 inch (0.127 and 1.27 millimeters). The fastener elements can be arranged in an array uniformly covering substantially the entire upper face of the sheet form base. The fastener elements can be arranged with a density of at least about 100 fastener elements per square inch (15.5 hooks per centimeter), for example at least about 1000 fastener elements per square inch (155 hooks per centimeter). The fastener elements can include hooks, can be mushroom shaped or palm tree shaped. The foam can include PVC or PU. The foam can be coated with metallic particles.

At least a portion of the lower face of the sheet-form base can be coated with metallic particles. At least a portion of the male fastener elements can be embedded with metallic particles. At least a portion of the foam can be embedded with metallic particles. The foam can extend longitudinally beyond the sheet form base. The lower face of the sheet form base can carrie an adhesive material. A non-woven fabric can be mounted on the lower face of the sheet-form base.

In another aspect, the invention includes a touch fastener including; a sheet form base having an upper face and a lower face; a foam positioned adjacent to the upper face of the sheet form base; and array of male fastener elements, each fastener element having a stem molded integrally with and extending from the upper face of the sheet form base, wherein the foam extends longitudinally beyond the sheet form base and wherein a portion of the foam is disposed between at least some of the fastener elements.

In some embodiments, the touch fastener includes one or more of the following features. The foam can be disposed between substantially all of the fastener elements. The touch fastener can include an adhesive on the lower face of the sheet form base. The foam can cover substantially the entire upper face of the sheet form base. The touch fastener can also include a plurality of arrays of male fastener elements arranged in longitudinally extending tracks, wherein the arrays of male fastener elements alternate with longitudinally extending tracks that are substantially free from male fastener elements.

In another aspect, the invention includes a touch fastener including; a sheet form base having an upper face and a lower face; a foam positioned adjacent to the upper face of the sheet form base; and an array of male fastener elements, each fastener element having a stem molded integrally with and extending from the upper face of the sheet form base, wherein a portion of the foam is disposed between at least some of the fastener elements and wherein the foam extends around the array of fastener elements, the foam extending around the array of fastener elements being of a height greater than the height of the fastener elements.

In some embodiments, the touch fastener includes one or more of the following features. The height of the foam disposed between the fastener elements can be greater than the height of the fastener elements. The foam can be disposed between substantially all of the fastener elements. The foam can cover substantially the entire upper face of the sheet form base. The touch fastener can also include an adhesive on the lower face of the sheet form base.

In another aspect, the invention includes a touch fastener including; a sheet form base having and upper face and a lower face; a plurality of male fastener elements, each fastener element having a stem molded integrally with and extending from the upper face of the sheet form base; and a fibrous non-woven material positioned adjacent to the upper face of the sheet form base, wherein a portion of the fibrous non-woven material is disposed between at least some of the fastener elements and wherein the fibrous non-woven material extends longitudinally beyond the sheet form base.

In some embodiments, the touch fastener includes one or more of the following features. The fibrous non-woven material can cover substantially the entire upper face of the sheet form base. The fibrous non-woven material can be disposed between substantially all of the fastener elements. The fibrous non-woven material can be felt.

In another aspect, the invention includes an adjustable cap including; a rim positioned to extend about a wearer's head; and an adjustable fastener arranged to permit adjustment of the rim; the fastener including a female touch fastener; and a male touch fastener configured for releasable engagement with the female touch fastener, and including an array of discrete male fastener elements extending from a common surface to distal ends, and a foam disposed on the common surface and extending across the array of fastener elements; wherein the foam extends from the common surface to beyond the distal ends of at least some of the fastener elements. In some embodiments, foam extends to beyond the distal ends of substantially all of the fastener elements with the foam in an uncompressed state.

In another aspect, the invention includes method of adjusting the size of a cap including; providing a cap including a rim positioned to extend about a wearer's head; and an adjustable fastener arranged to permit adjustment of the rim; the fastener including a female touch fastener; and a male touch fastener configured for releasable engagement with the female touch fastener, and including an array of discrete male fastener elements extending from a common surface to distal ends, and a foam disposed on the common surface and extending across the array of fastener elements; wherein the foam extends from the common surface to beyond the distal ends of at least some of the fastener elements; trying on the cap on a subject, and engaging the male and female touch fasteners. In some embodiments, foam extends to beyond the distal ends of substantially all of the fastener elements with the foam in an uncompressed state.

In another aspect, the invention includes a sealable bag including a body having a first opposing side wall and a second opposing side wall, the first and the second side walls having edges, the edges being joined to form therebetween a pouch having an open end; a closure including first and second elongated fastener strips, wherein the first elongated strip is attached to the first opposing side wall and includes female fastener elements, and wherein the second elongated fastener strip is attached to the second opposing side wall and comprises male fastener elements from a first surface and foam disposed on the first surface wherein at least a portion of the foam is disposed between the male fastener elements and at least a portion of the foam extends to a height greater than the height of the male fastener elements. In some embodiments, the height of the foam is greater than the height of substantially all of the male fastener elements when the foam is not compressed.

In another aspect, the invention includes a closable garment including: a garment having a first portion and a second portion; and a first cooperative fastener for securing the garment on a wearer, the first fastener including a female fastener component on the first portion of the garment, and a second cooperative fastener on the second portion of the garment, arranged for cooperative engagement with the first cooperative fastener; wherein the second cooperative fastener includes male fastener elements and a foam disposed on a first surface, wherein the foam is disposed between at least a portion of the male fastener elements, and wherein the height of at least a portion of the foam is greater than the height of at least some of the male fastener elements. In some embodiments, the height of the foam is greater than the height of substantially all of the male fastener elements when the foam is not compressed.

In another aspect, the invention includes a stackable floor mat including: a mat including a flexible material having and upper surface and a lower surface; and a fastener secured to the lower surface of the mat, the fastener including a sheet form base having an inner face secured to the lower surface of the mat and an outer face, a plurality of male fastener elements disposed on at least a portion of the outer face of the base, and foam disposed on at least the portion of the outer face of the base where the male fastener elements are disposed, wherein the height of the foam is greater than the height of the male fastener elements.

In some embodiments, the stackable floor mat includes one or more of the following features. The height of the foam can be greater than the height of substantially all of the male fastener elements when the foam is not compressed. The material can be a synthetic material. The mat can be a rubber mat. The material can be a natural material. The mat can include a mixture of natural and synthetic material.

In another aspect, the invention includes a door including; an aperture defining an opening sized for a domesticated animal to pass there through; and a door, wherein affixed to a first side of the door and sized to cover the aperture comprises a material having a first surface and a second surface; secured to the first side of the door, is a first cooperative fastener including female fastener elements; and secured to the material and arranged for cooperative engagement with the first cooperative fastener, a male touch fastener including a sheet form base having an inner face secured to the material and an outer face, a plurality of male fastener elements disposed on at least a portion of the outer face, and foam disposed on at least the portion of the outer face of the base and between at least a portion of the male fastener elements, wherein the height of the foam is greater than the height of at least a portion of the male fastener elements. In some embodiments, the height of the foam is greater than the height of substantially all of the male fastener elements when the foam is not compressed.

In another aspect, the invention includes a hair roller including; an elongated central portion including, a first end and a second end, each of which are formed on opposed surfaces of the central portion, and a generally cylindrical shape having a substantially circular shaped cross-section throughout its length; and secured to the central portion, a cooperative fastener including a sheet form base having an inner face secured to the central portion and an outer face, a plurality of male fastener elements disposed on at least a portion of the outer face of the base, and foam disposed on at least the portion of the outer face of the base where the male fastener elements are disposed, wherein the height of the foam is greater than the height of at least a plurality of the male fastener elements.

In some embodiments, the hair roller includes one or more of the following features. The height of the foam can be greater than the height of substantially all of the male fastener elements when the foam is not compressed. The fastener can be positioned to extend along the elongated center portion substantially from the first end to the second end. The hair roller can include a plurality of cooperative fasteners. The surface area of the central portion can be generally a continuous cylinder, the surface area of the central portion can be discontinuous, or the surface area of the central portion can include discontinuous strips of material extending from the first end to the second end of the central portion.

In another aspect, the invention includes a flooring including; a material having an upper and a lower surface; and secured to the lower surface, a cooperative fastener including a sheet form base having an inner face secured to the lower surface of the material and an outer face, a plurality of male fastener elements disposed on at least a portion of the outer face of the base, and foam disposed on at least the portion of the outer face of the base where the male fastener elements are disposed, wherein the height of the foam is greater than the height of a plurality of the male fastener elements.

In some embodiments, the flooring includes one or more of the following features. The height of the foam can be greater than the height of substantially all of the male fastener elements when the foam is not compressed. The material can be a flexible material, a synthetic material, or a natural material. The flooring can be sized to approximate the surface area of a floor of a room.

In another aspect, the invention includes a method of securing a door. The method includes; securing a first cooperative cooperative fastener to a door frame; securing a second cooperative cooperative fastener to a door arranged for cooperative engagement with the first cooperative cooperative fastener, the second cooperative cooperative fastener including a sheet form base having an inner face secured to the door and an outer face, a plurality of male fastener elements disposed on at least a portion of the outer face of the base, and foam disposed on at least the portion of the outer face of the base where the male fastener elements are disposed, wherein the height of the foam is greater than the height of a plurality of the male fastener elements; and closing the door to engage the first and second cooperative cooperative fasteners. In some embodiments, the height of the foam is greater than the height of substantially all of the male fastener elements when the foam is not compressed.

In another aspect, the invention includes a box having; six sides, and secured on one side a cooperative fastener including a sheet form base having an inner face secured to the box and an outer face, a plurality of male fastener elements disposed on at least a portion of the outer face of the base, and foam disposed on at least the portion of the outer face of the base where the male fastener elements are disposed, wherein the height of the foam is greater than the height of a plurality of the male fastener elements.

In some embodiments, the box includes one or more of the following features. The height of the foam can be greater than the height of substantially all of the male fastener elements when the foam is not compressed. The box can be sized to hold 12 cans configured in a 6 by 2 configuration. A plurality of cooperative fasteners can be secured to the box.

In another aspect, the invention includes an absorbent article including a flexible strip including a sheet form base having an inner face and an outer face, a plurality of male fastener elements disposed on at least a portion of the outer face of the flexible strip, and foam disposed on at least the portion of the outer face of the flexible strip where the male fastener elements are disposed, wherein the height of the foam is greater than the height of a plurality of the male fastener elements. The absorbent article can be, for example, a diaper, a feminine hygiene product, a training pant, an incontinence product, or a medical garment.

The touch fasteners described can include one or more of the following benefits. The touch fasteners can be deactivated, so as to not inadvertently become engaged with fibrous materials. The foam may provide a barrier to the male fastener elements that will prevent fouling of the fastener elements, thus providing a longer lasting touch fastener. The foam may also provide an improved hand to the male fastener element, preventing a scratchy or rough feel of the male fastener elements against a user's skin.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
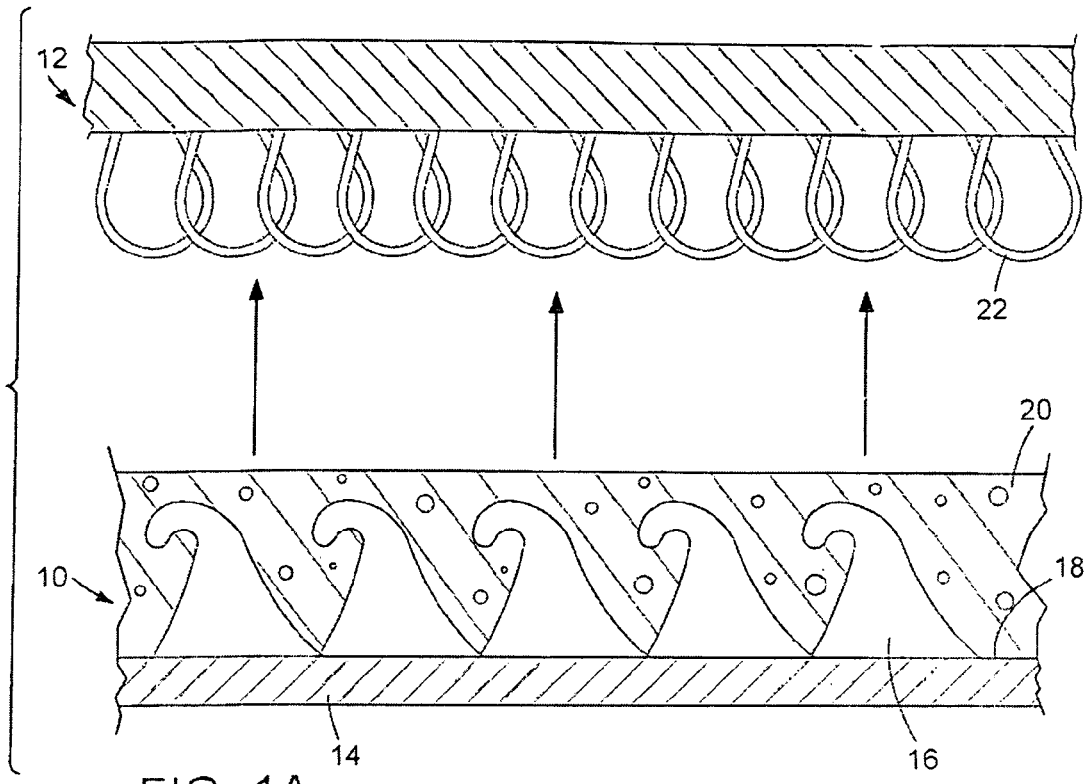
FIGS. 1A and 1B show a male touch fastener engaging with a female touch fastener, in unengaged and engaged states, respectively.
Figure 1B:
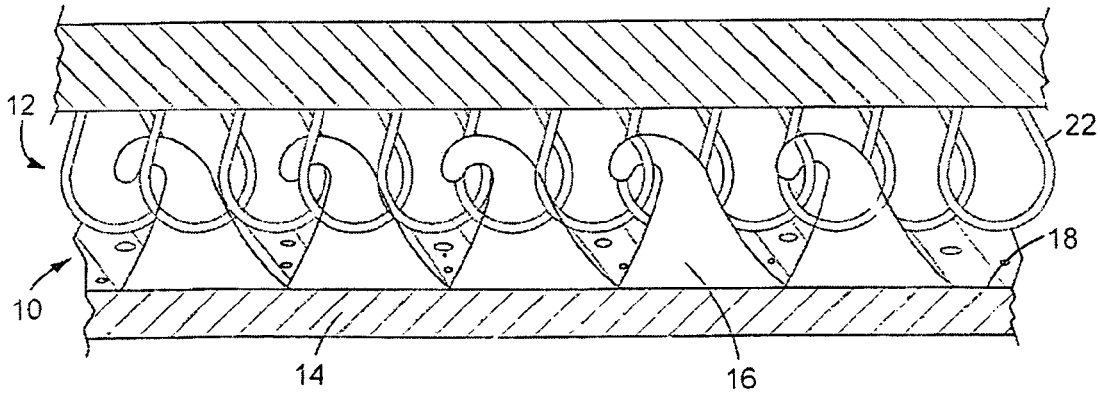

FIG. 1A depicts a male touch fastener 10 and a female touch fastener 12. The male touch fastener 10 includes a base 14 with male fastening elements 16 extending from the upper face 18 of the base 14. Surrounding the male fastener elements 16 is a foam 20. When the male touch fastener 10 is not engaged with the female touch fastener 12, the height of the foam 20 is greater than the height of the male fastener elements 16. As can be seen in FIG. 1B, when the male touch fastener 10 becomes engaged with the female touch fastener 12, the female fastening elements 22 compress the foam 20 to expose the male fastening elements 16, allowing the male fastening elements 16 to engage with the female fastening elements 22.

Figure 3:
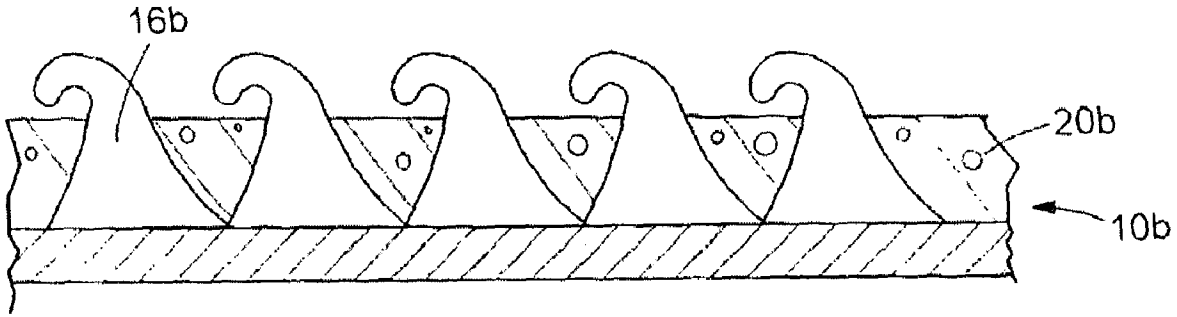
FIG. 3 depicts a touch fastener where the male fastener elements are surrounded by foam, with the height of the fastener elements greater than the height of the foam when the touch fastener is not engaged.
Figure 2:
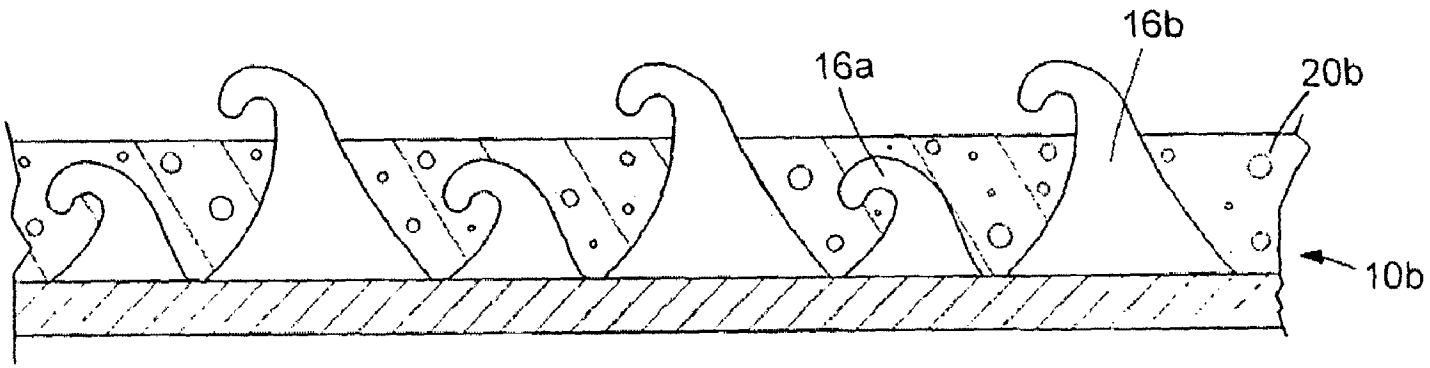
FIG. 2 illustrates a touch fastener where some of the male fastener elements are submerged in foam when the touch fastener is not engaged while other male fastener elements extend above the height of the foam.

FIGS. 2 and 3 depict alternative embodiments of the male touch fastener. The male touch fastener 10*a* in FIG. 2 includes some male fastener elements 16*a* that have a height exceeding the height of the foam 20*a* when the male touch fastener 10*a* is not engaged with a female touch fastener. The male fastening elements 16*b* of the touch fastener 10*b* depicted in FIG. 3 all are of a height greater than the height of the foam 20*b* when the male touch fastener 10*b* is not engaged with a female touch fastener. In some instances, for example as depicted in FIGS. 2 and 3, it is desirable to have a portion of the hooks exposed through the foam. For example the exposed portion of the hook can be more easily engaged with a female touch fastener while still being somewhat protected from fouling.

Figure 4:
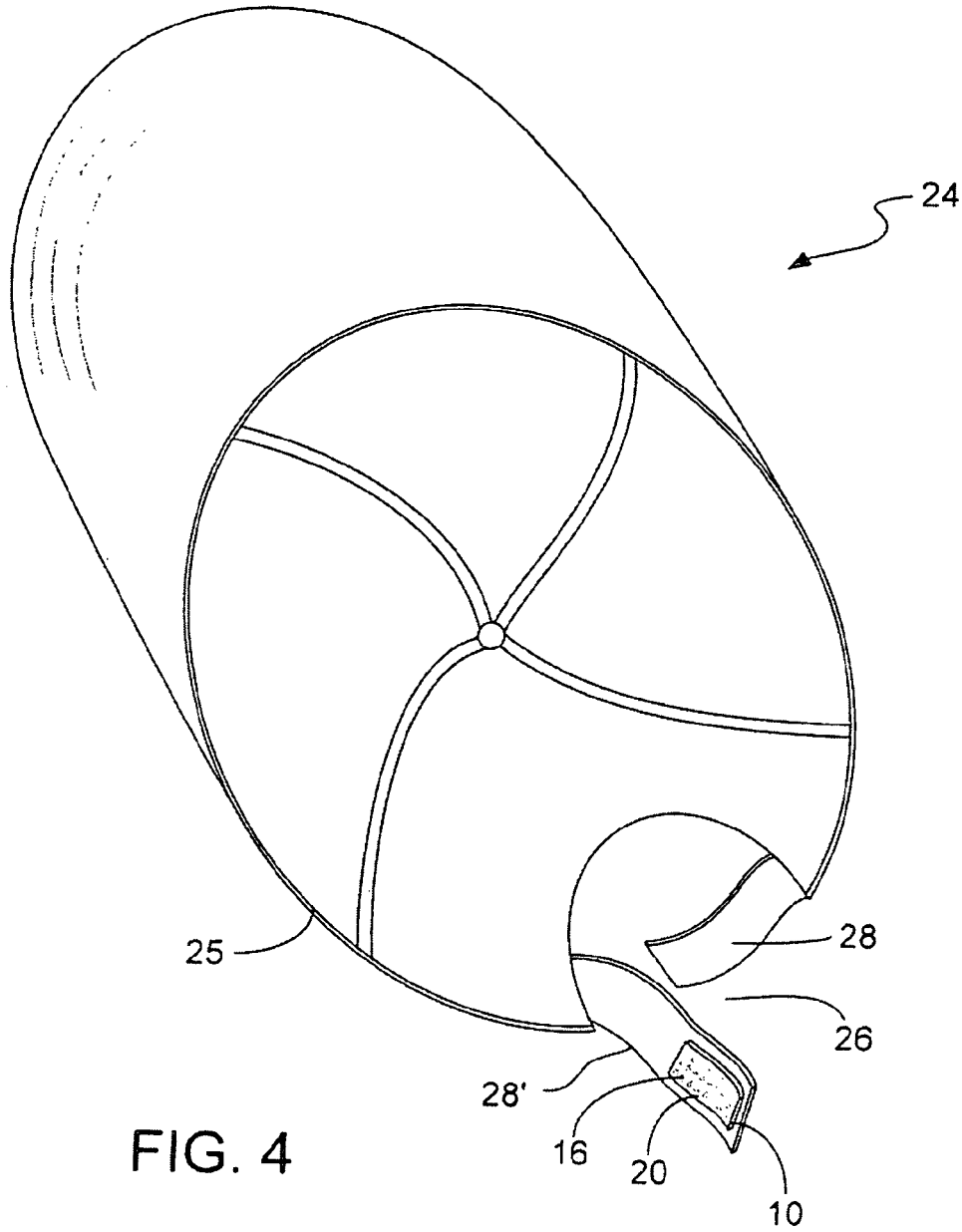
FIG. 4 depicts a cap including a touch fastener that can be used to adjust the size to a wearer's head.

FIG. 4 depicts a cap 24 having a mechanism to adjust its size. The cap 24 includes a rim 25 with a rear region 26 that allows for sizing of the cap to fit the head of the wearer. The rear region 26 includes straps 28 and 28'. Strap 28 includes female fastening elements (such as a loop product, not shown) on an inner face. Strap 28' includes a male touch fastener 10 where the male fastener elements 16 are submerged by foam 20 as depicted in FIG. 1A. The straps 28 and 28' are cooperatively engaged to provide an appropriate size for the wearer.

Figure 5A:
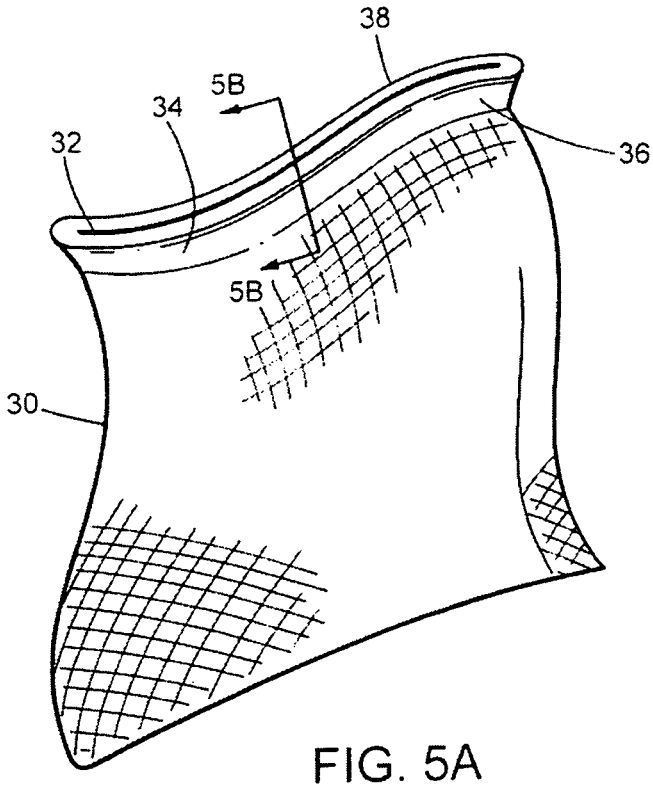
FIG. 5A is a perspective view of a bag having a closure mechanism that includes a touch fastener.
Figure 5B:
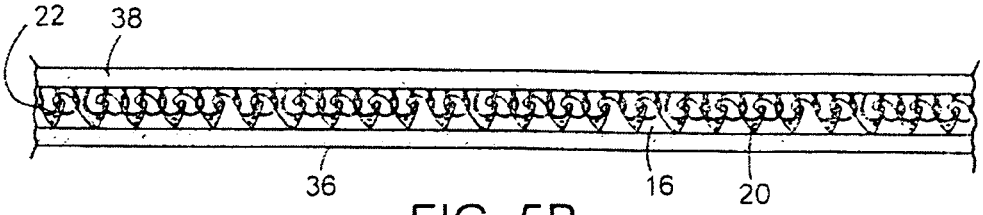
FIG. 5B is a cross-sectional view, taken along line 5B-5B in FIG. 5A.

A bag 30 having a closure mechanism 32 is depicted in FIGS. 5A and 5B. The bag 30 can be, for example, made from a mesh material and used in a washer or dryer. As depicted in FIG. 5B, the upper portion 34 of the bag 30 includes male fastener elements 16 on the front face 36 and female fastener elements 22 on the rear face 38. To effect closure of the bag 30, the upper portions of the bag 34 having cooperative fastener elements is pushed together for releasable engagement. When not engaged, the male fastening elements 16 are submerged in foam 20 as described in FIG. 1A. Because the male fastener elements 16 are submerged in foam 20 when not engaged with the female fastener elements 22, unwanted engagement of the male fastener elements 16 with fabric is reduced. For example, when the bag 30 is used in a clothes dryer, the submersion of the male fastener elements 16 can significantly reduce, and in some cases prevent, the male fastener elements 16 from engaging with clothing such as sweaters and other articles.

Figure 6:
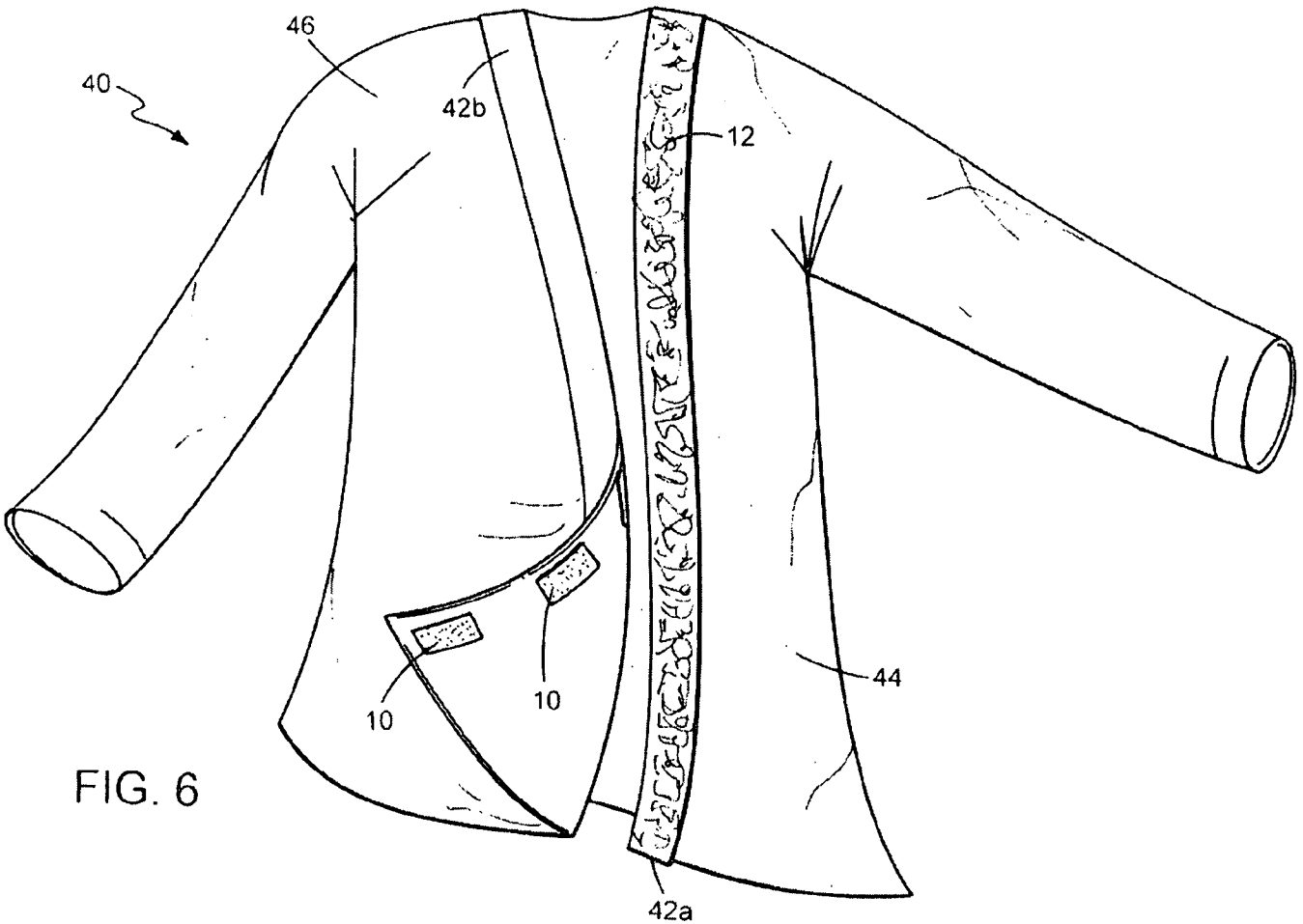
FIG. 6 depicts a garment having a closure mechanism that includes a touch fastener.

FIG. 6 depicts a jacket 40 having a closure mechanism 42*a* and 42*b* that includes cooperative touch fasteners. A first side of the jacket 44 includes a female touch fastener 12, and a second side of the jacket 46 includes male touch fasteners 10. As shown in FIG. 1A, when the male touch fasteners 10 are not engaged with the female fastener 12, the male fastener elements 16 are submerged in foam 20. The submersion of the male fastener elements 16 in the foam 20 can help to prevent unwanted engagement of the male fastener elements 16. For example, the male fastener elements 16 are less able to inadvertently engage with other articles on a wearer, such as a sweater or a scarf. Moreover, submersion of the male fasteners elements 16 can improve the feel of the touch fasteners when the touch fasteners are not engaged, reducing a scratchy feeling against the skin of a wearer.

Figure 7:
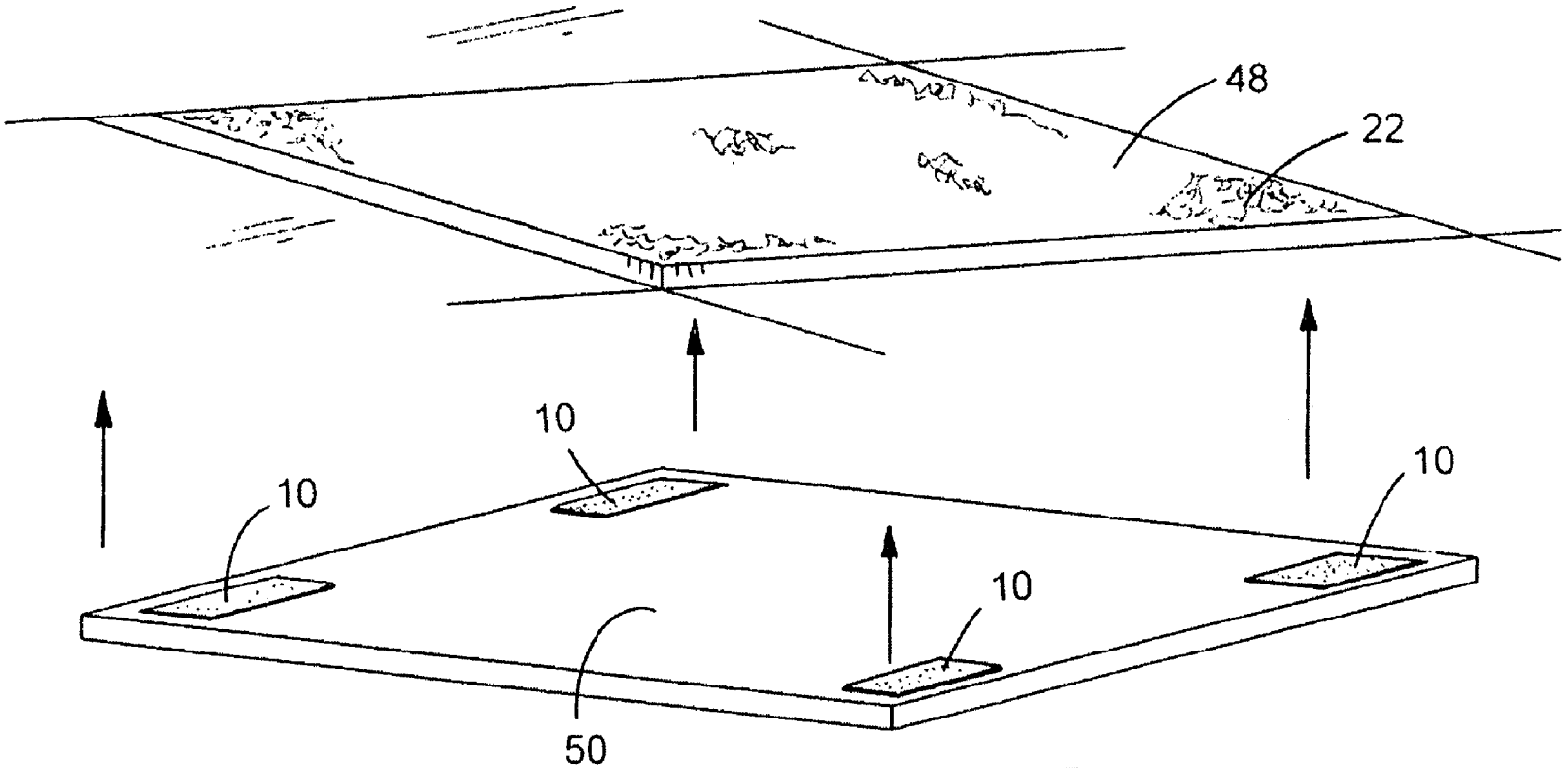
FIG. 7 depicts a flooring having an attachment mechanism that includes a touch fastener where the male touch fastener includes male fastener elements that are submerged in foam when the touch fastener is not engaged.

FIG. 7 shows a flooring tile 48 that is attached to a floor using cooperative touch fasteners. The male touch fasteners 10 having male fastener elements 16 submerged in foam 20 as depicted in FIG. 1A are positioned on the sub floor 50. In an alternative embodiment, the tile could be a ceiling tile attached to a ceiling, for example as used in a clean room.

Figure 8:
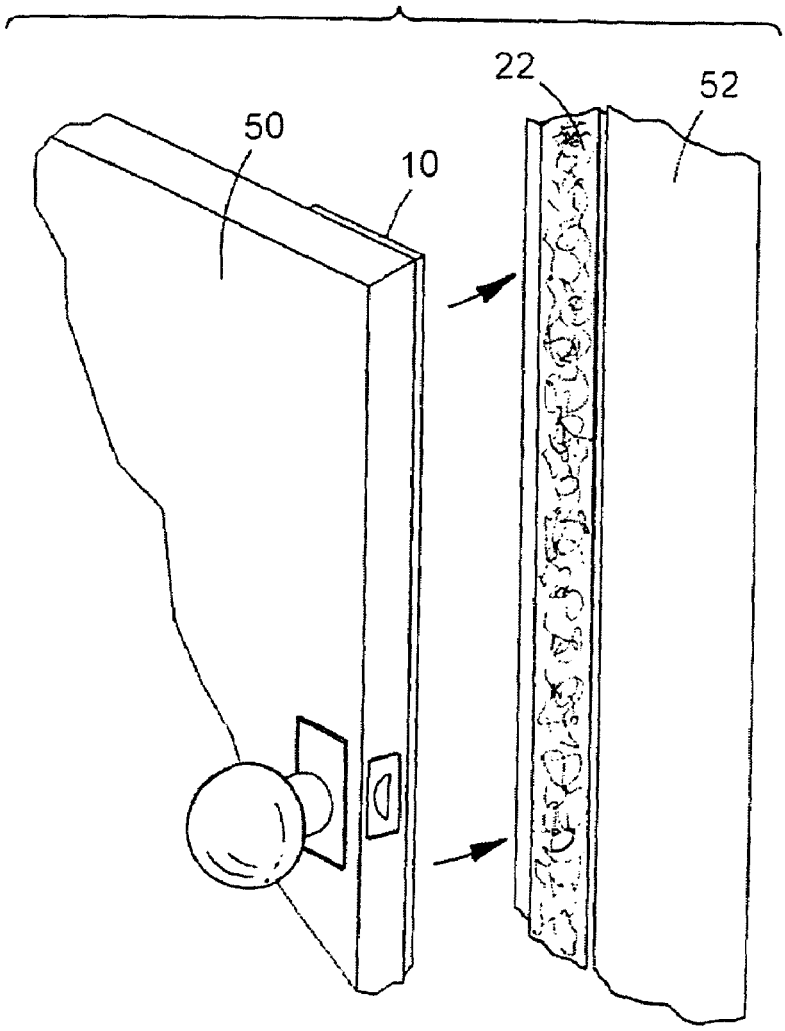
FIG. 8 depicts a door having a closure mechanism that includes a touch fastener.
Figure 9:
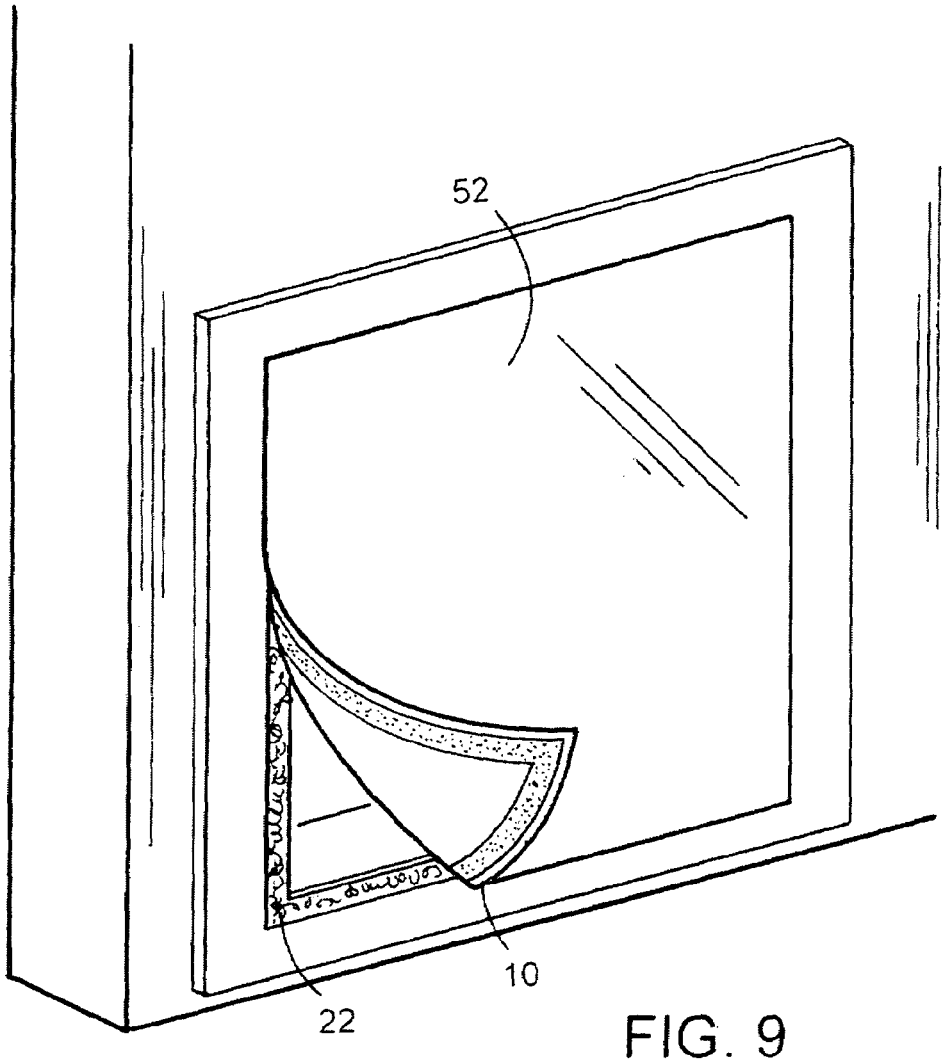
FIG. 9 depicts a pet friendly door having a closure mechanism that includes a touch fastener.

FIG. 8 depicts a door 50 and door frame 52 having cooperative touch fasteners, which provide a closure mechanism. The door 50 includes male touch fasteners 10 having male fastener elements 16 submerged in foam 20. Female fastener elements 22 are positioned on the door frame 52 to engage with the male fastener elements 16. When pressure is applied in the closing of the door 50, the female fastener elements 22 submerge the foam 20 to expose the male fastener elements 16 and allow engagement of the cooperative touch fasteners. Because the male fastener elements 16 are submerged in foam 20 when not engaged with the female fastener elements 22, inadvertent engagement and fouling of the male fastener elements 16, e.g., on articles of clothing, is reduced. An alternative door 52 is depicted in FIG. 9, for example a door within a door, for which a pet can enter and exit. Submersion of the male fastener elements when not engaged reduces the inadvertent engagement of the male fastener elements, for example, with the fur of an animal as the animal passes through the door.

Figure 10A:
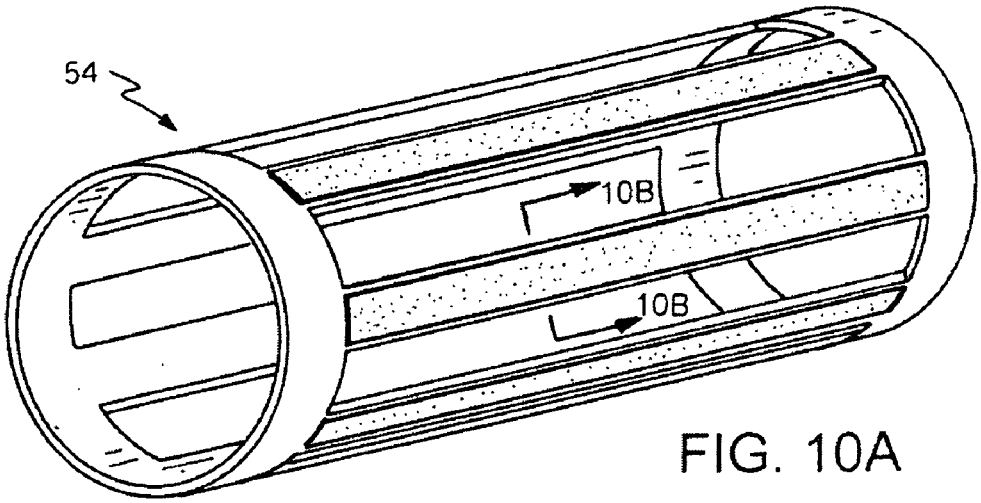
FIG. 10A is a perspective view of a hair roller having a mechanism to attach the roller to the hair of a user.
Figure 10B:
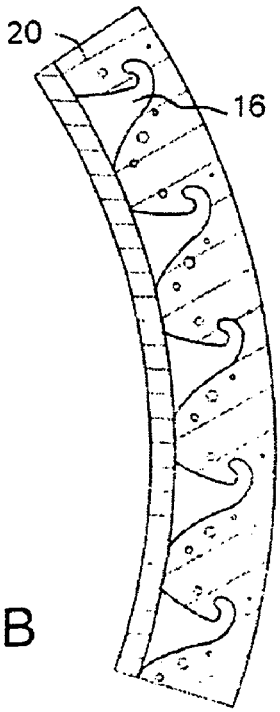
FIG. 10B is a cross-sectional view, taken along line 10B-10B in FIG. 10A.

FIGS. 10A and 10B depict a roller 54 having male fastener elements 16 submerged in foam 20. In use, a user will roll the hair onto the roller 54, applying pressure between the hair and the roller 54 when the roller 54 is correctly positioned. The pressure will compress the foam 20, exposing the male fastener elements 16 to the hair, which will engage with the male fastener elements 16 and hold the roller 54 in position. Because the male fastener elements 16 are submerged in foam 20 (See FIG. 10B), the user is better able to control the position of the roller 54 by having improved control of the timing of engagement of the male fastener elements 16 with the hair of the user.

Figure 11:
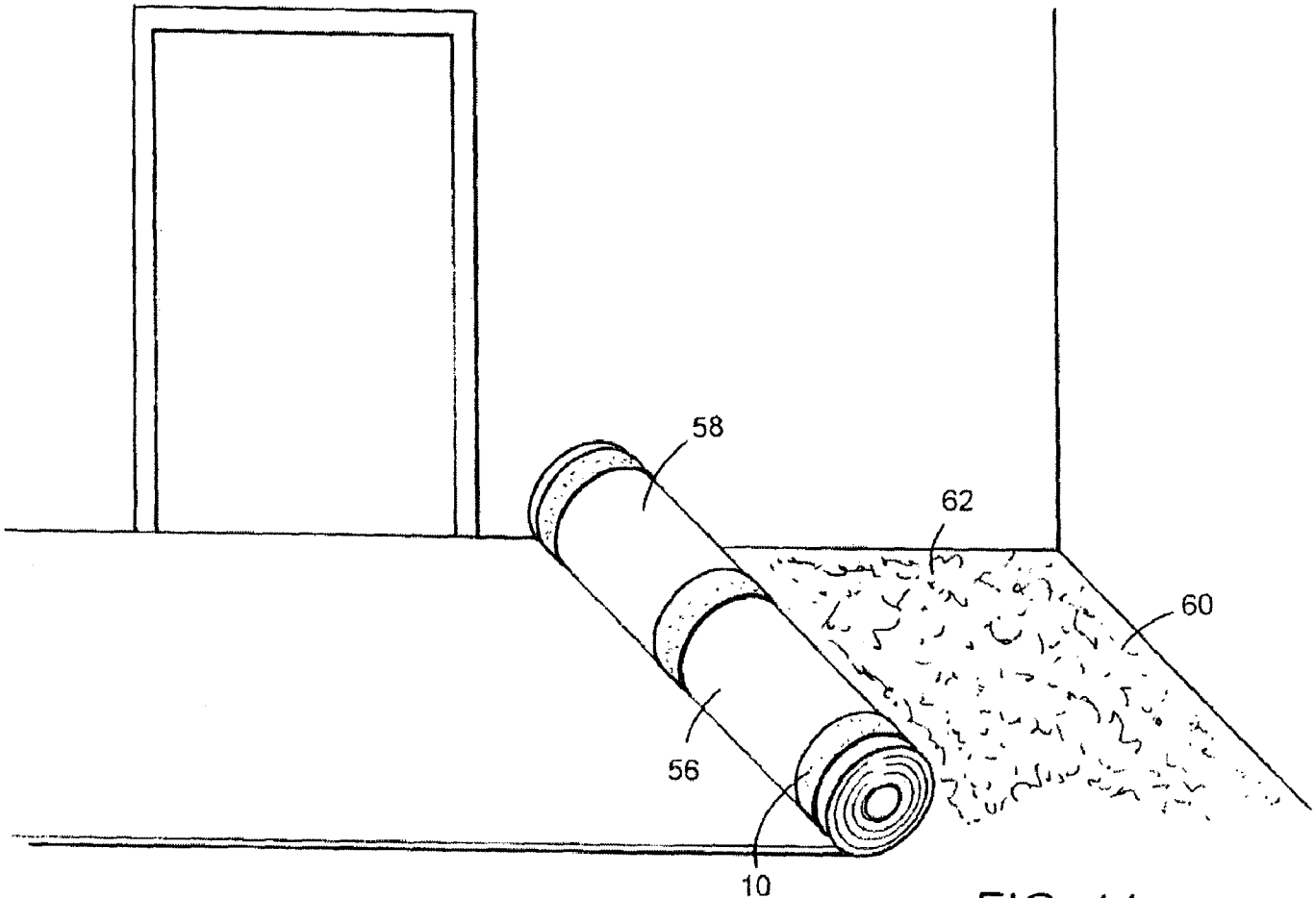
FIG. 11 depicts a flooring that includes male fastener elements submerged in foam when the fastener elements are not engaged.

FIG. 11 depicts a sheet form flooring 56, e.g., a carpet, having male touch fasteners 10 positioned on a lower face 58 of the flooring. The male touch fasteners 10 include male fastener elements 16 submerged in foam 20 as depicted in FIG. 1A. The flooring 56 is positioned on a sub-floor 60 having female fastener elements 62 thereon. Upon application of the flooring 56, pressure is applied to compress the foam 20 of the male touch fasteners 10, engaging the male and female fastener elements 16 and 20.

Figure 12:
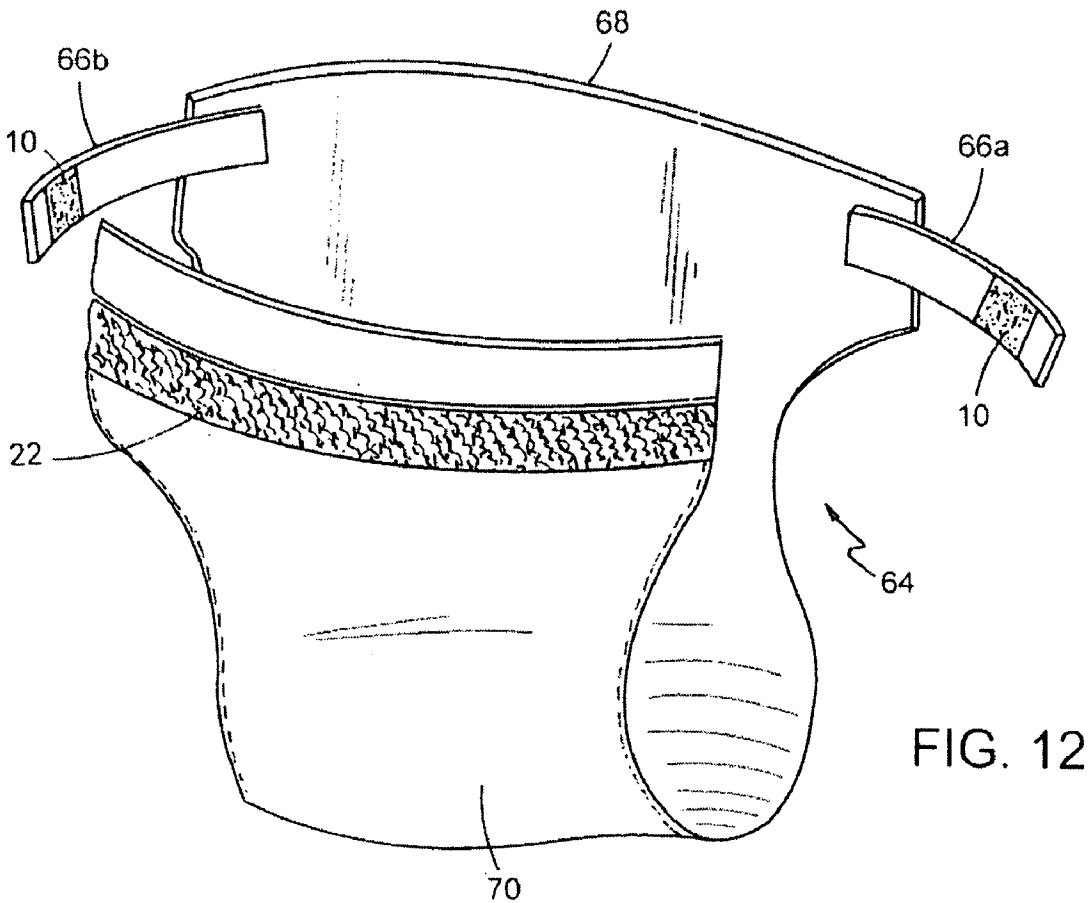
FIG. 12 depicts a diaper that includes a touch fastener.

FIG. 12 depicts a diaper 64 with closures 66*a* and 66*b* that include cooperative touch fasteners. The rear 68 of the diaper 64 includes male touch fasteners 10 described above. The front of the diaper 70 includes female fastener elements 22. When the diaper 64 is positioned on the wearer, pressure is applied to the cooperative touch fasteners to engage the male and female fastener elements 16 and 20. Because the male fastener elements 16 are submerged in foam 20 when unengaged, the male fastener elements 16 are less able to scratch or irritate the skin of the wearer. Moreover, the male fastener elements 16 are less able to become unintentionally engaged, for example with an article of clothing of the wearer. While a diaper is depicted in FIG. 12, other absorbent articles are also envisioned. For example, feminine hygiene products, training pants, and incontinence products are also envisioned.

Figure 13:
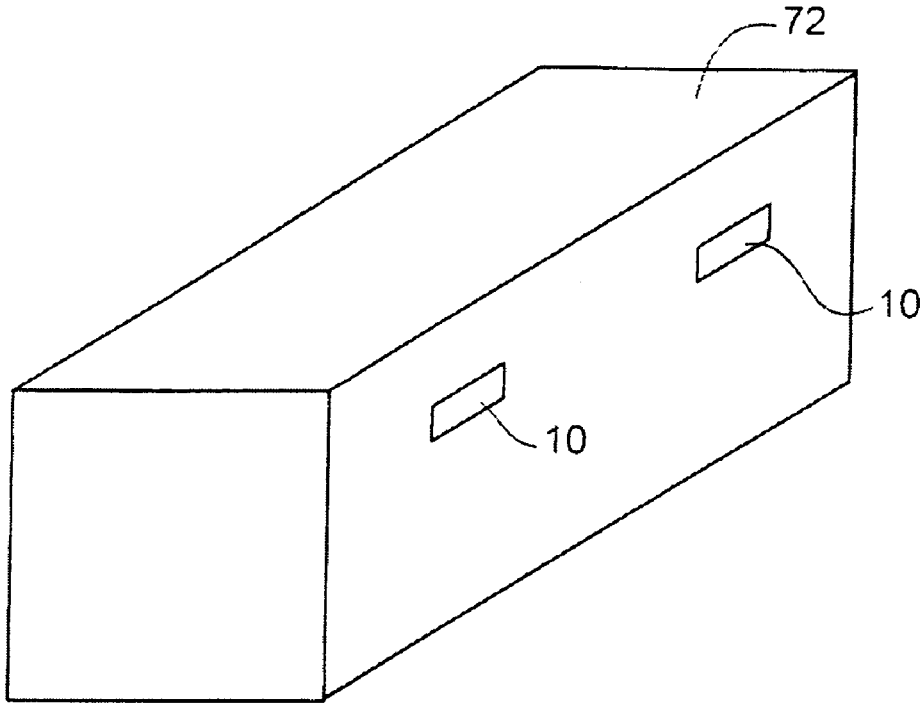
FIG. 13 depicts a box that includes a touch fastener.

FIG. 13 depicts a box 72 having male touch fasteners 10, discussed above, positioned thereon. The box 72 can be shaped, for example, to hold twelve 16-ounce cans of soda positioned in two rows of six. In some instances, the box 72 can be removably attached to a second box of the same shape. The boxes can be attached, for example, during the packaging process of canned beverages. The boxes can be subsequently removed, for example, upon delivery to a distribution center such as a grocery store. More details of such an application can be found in U.S. provisional application 60/555,613, filed Mar. 23, 2004, the entire contents of which are hereby incorporated by reference.

Figure 14:
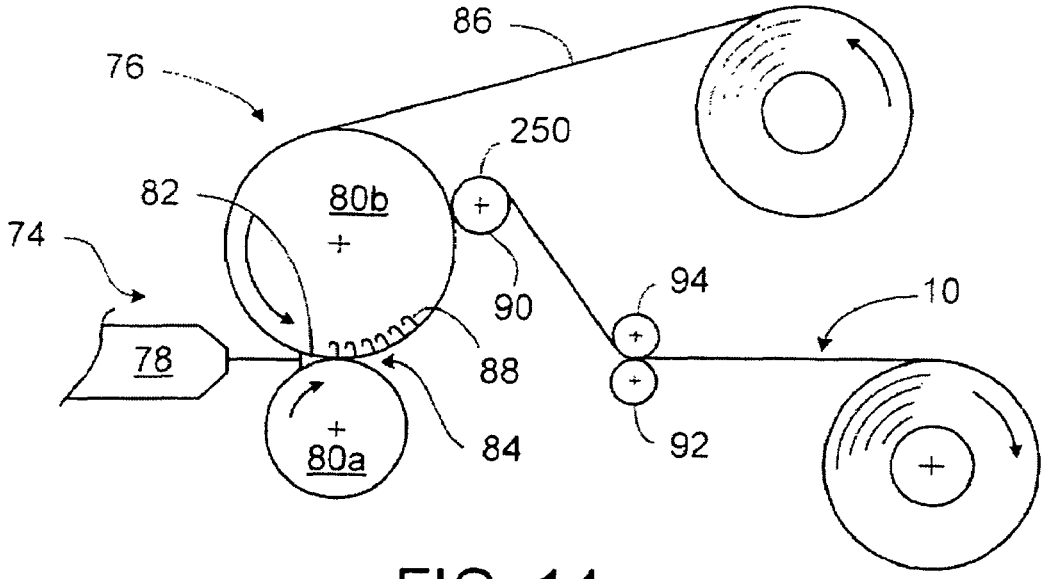
FIG. 14 shows schematically an apparatus and process for manufacturing a touch fastener having foam attached to the upper face of a sheet form base.

FIG. 14 illustrates one method and apparatus for producing the above described touch fasteners. The method utilizes the continuous extrusion/roll-forming method for molding fastener elements on an integral, sheet-form base described in detail in U.S. Pat. No. 4,794,028, the disclosure of which is incorporated herein by reference. As shown in FIG. 14, touch fastener 10 is formed by an extrusion apparatus 74 including a molding/calendaring assembly 76. The assembly includes an extrusion head 78, a base roll 80*a*, and a mold roll 80*b*. In FIG. 14, the relative position and size of the rolls and other components is not to scale.

The extrusion head 78 supplies a continuous sheet of molten resin 82 to a nip 84 formed between a base roll 80*a* and a mold roll 80*b*. As molten resin 82 enters nip 84, a sheet of foam 86 is fed through the nip 84 between the mold roll 80*b* and the molten resin 82. Due to pressure applied at the nip by rolls 80*a* and 80*b*, molten resin 82 is forced through the foam 86 into hook cavities 88, forming the hooks 16 described above. A guide roller 90 is situated diagonally upwardly to assist in the removal of the finished touch fastener 10 from mold roll 80*b*. A set of upper and lower take-up rollers 92, 94, rotating at a speed slightly higher than the rotating speed of the die wheel 80*b*, are situated forwardly of the guide roller 90.

Figure 15:
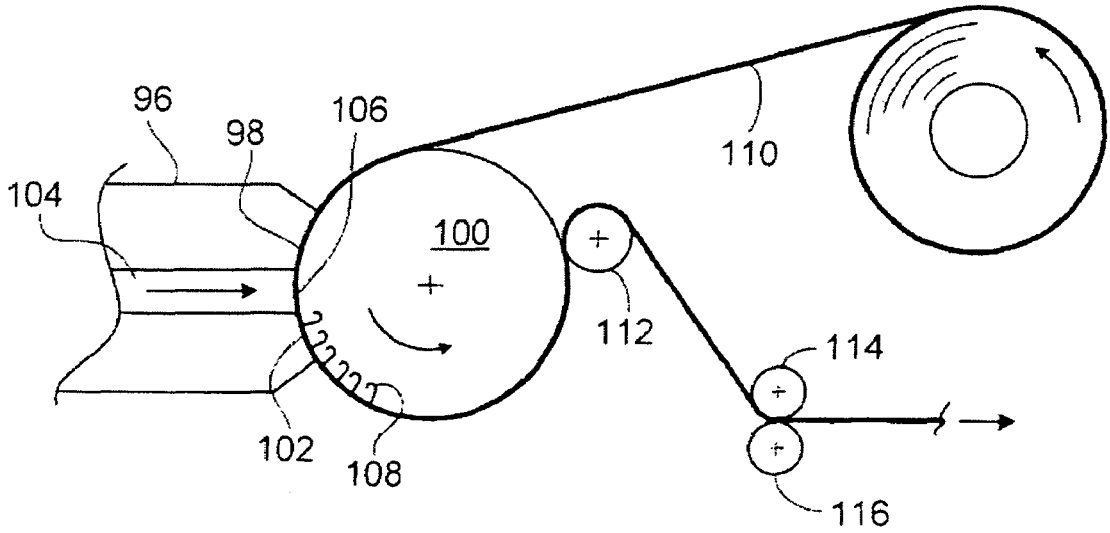
FIG. 15 shows schematically an apparatus and process for manufacturing a touch fastener having foam attached to the upper face of a sheet form base.

FIG. 15 shows an alternative process for manufacturing a touch fastener having a foam embedded into the upper face of a sheet-form base. An injection die 96 has an upper half arcuate surface 98 that is substantially equal in curvature to a die wheel 100, and a lower half surface 102 having a curvature that defines a predetermined gap with respect to the curved surface of the die wheel 100. The injection die 96 has a resin extrusion outlet 104, which is situated centrally of the upper and lower surfaces 98, 102 and from which molten resin 106 is extruded in a sheet form under a predetermined pressure.

The structure of the die wheel 100 is substantially identical with the structure disclosed in U.S. Pat. No. 4,775,310, which is incorporated herein by reference in its entirety. Die wheel 100 defines a multiplicity of hook-element-forming cavities 108 with their bases opening to the circumferential surface of the die wheel. The die wheel 100 is driven to rotate in the direction indicated by the arrow in FIG. 15.

A sheet of foam 110 is drawn from a roll and introduced between the upper arcuate surface 98 of the injection die 96 and the circumferential surface of the die wheel 100. A guide roller 112 is situated diagonally upwardly, and a set of upper and lower take-up rollers 114, 116 rotating at a speed slightly higher than the rotating speed of the die wheel 100, are situated forwardly of the guide roller 112.

The foam is compressed as it enters into the nip (as shown in FIG. 14) or the predetermined gap (as shown in FIG. 15), and is in a compressed state as the pressure forces the molten resin through the foam and into the hook cavities in the mold roll (see FIG. 14) or the die wheel (see FIG. 15). While foam generally springs back to its former thickness, a portion of the foam sticks (e.g., physically adheres or bonds) to the molten resin as it moves through the nip, and does not spring back to its original thickness. Thus, where the foam is embedded in the sheet form base, it generally has a thickness that is less than its thickness prior to adhering to the molten resin. Moreover, the portions of the foam in direct contact with the fastener elements also physically bond to the molten resin that enters into the mold cavity (88 or 108), causing an even greater reduction in the springing back of the foam in areas of the sheet form base adjacent to fastener elements. The degree to which a foam springs back to it original thickness varies with the type and density of foam and is generally expressed as a percentage.

In some cases, the foam springs back to a thickness that is greater than the height of the fastener elements, causing the fastener elements to be entirely submerged in the foam. Although the fastener elements can be entirely submerged in the foam, loops of appropriate stiffness can be used to push through the foam and engage the hooks as discussed above.

As described above, the resin pierces through the foam to enter mold cavities that form the male fastener elements. Accordingly, the pierce in the foam also provides an opening for the male fastener elements to push through upon engagement with female fastener elements. In some embodiments, aggressive male fastener elements are used to more easily allow engagement of the male fastener elements with female fastener elements. For example male fastener elements of a stiff material or male fastener elements having a sharp edge can more easily push through the foam when the male fastener elements are submerged by the foam. Because in this instance the male fastener elements are submerged in foam when not engaged with female fastener elements, the more aggressive male fastener elements will not negatively impact the feel of the touch fastener, for example on the skin of the user.

In some instances, the hook cavities 88 in the mold roll 80*b* are positioned to manufacture touch fasteners having fastener elements that do not uniformly cover the sheet form base, but rather are positioned in longitudinally disposed strips.

A number of embodiments of the invention have been described. Nevertheless, it will be understood that various modifications may be made without departing from the spirit and scope of the invention. Accordingly, other embodiments are within the scope of the following claims.

What is claimed is:

1. A touch fastener, comprising:

a sheet form base having an upper face and a lower face;

a plurality of male fastener elements, each fastener element having a stem molded integrally with and extending from the upper face of the sheet form base; and a foam positioned adjacent to the upper face of the sheet form base, the foam extending longitudinally beyond the sheet form base and to a height greater than the height of at least some of the male fastener elements, and completely covering those fastener elements, wherein a portion of the foam is disposed between at least some of the fastener elements and wherein the fastener elements that are completely covered with foam are exposed for engagement when the foam is compressed.

2. The touch fastener of claim 1, wherein the foam is disposed between substantially all of the fastener elements.

3. The touch fastener of claim 1, wherein the foam covers substantially the entire upper face of the sheet form base.

4. The touch fastener of claim 1, wherein the foam is attached to the upper face of the sheet form base.

5. The touch fastener if claim 1, wherein the foam is embedded in the upper face of the sheet form base.

6. The touch fastener of claim 1, wherein the foam is an open cell foam.

7. The touch fastener of claim 1, wherein the fastener elements are arranged in longitudinally extending tracts.

8. The touch fastener of claim 1, wherein the fastener elements have a height of less than about 0.05 inch (1.37 millimeters).

9. The touch fastener of claim 1, wherein the fastener elements have a height of between about 0.005 and 0.05 inch (0.127 and 1.27 millimeters).

10. The touch fastener of claim 1, wherein the fastener elements are arranged in an array uniformly covering substantially the entire upper face of the sheet form base.

11. The touch fastener of claim 1, wherein the fastener elements are arranged with a density of at least about 100 fastener elements per square inch (15.5 hooks per centimeter).

12. The touch fastener of claim 11, wherein the fastener elements are arranged with a density of at least about 1000 fastener elements per square inch (155 hooks per centimeter).

13. The touch fastener of claim 1, wherein the fastener elements comprise hooks.

14. The touch fastener of claim 1, wherein the fastener elements are mushroom shaped.

15. The touch fastener of claim 1, wherein the fastener elements are palm tree shaped.

16. The touch fastener of claim 1, wherein the foam comprises PVC.

17. The touch fastener of claim 1, wherein the foam comprises PU.

18. The touch fastener of claim 1, wherein the foam is coated with metallic particles.

19. The touch fastener of claim 1, wherein at least a portion of the lower face of the sheet-form base is coated with metallic particles.

20. The touch fastener of claim 1, wherein at least a portion of the male fastener elements are embedded with metallic particles.

21. The touch fastener of claim 1, wherein the lower face of the sheet form base carries an adhesive material.

22. The touch fastener of claim 1, wherein a non-woven fabric is mounted on the lower face of the sheet-form base.

23. A touch fastener comprising;

a sheet form base having an upper face and a lower face;

a loam positioned adjacent to the upper face of the sheet form base and extending longitudinally beyond the sheet form base; and an array of male fastener elements, each fastener element having a stem molded integrally with and extending from the upper face of the sheet form base, wherein a portion of the foam is disposed between at least some of the fastener elements, wherein the foam extends around the array of fastener elements, the foam extending around the array of fastener elements being of a first height greater than the height of the fastener elements, and wherein the foam is compressible to a second height that is less than the height of the fastener elements, wherein the height of the foam disposed between the fastener elements is greater than the height of the fastener elements, covering those fastener elements, and wherein the fastener elements that are completely covered with foam are exposed for engagement when the foam is compressed.

24. The touch fastener of claim 23, wherein the foam is disposed between substantially all of the fastener elements.

25. The touch fastener of claim 23, wherein the foam covers substantially the entire upper face of the sheet form base.

26. The touch fastener of claim 23 further comprising an adhesive on the lower face of the sheet form base.

* * * * *

UNITED STATES PATENT AND TRADEMARK OFFICE

CERTIFICATE OF CORRECTION

PATENT NO. : 7,422,783 B2
APPLICATION NO. : 10/997802
DATED : August 20, 2008
INVENTOR(S) : Heidi S. Tremblay It is certified that error appears in the above-identified patent and that said Letters Patent is hereby corrected as shown below:

In Col. 10, Line 42, Claim 5 delete "if" and insert --of--, therefor.

In Col. 11, Line 22, Claim 23 delete "loam" and insert --foam--, therefor.

Signed and Sealed this

Eighteenth Day of November, 2008

JON W. DUDAS
*Director of the United States Patent and Trademark Office*